United States Patent [19]

Bechstedt

[11] 4,286,956

[45] Sep. 1, 1981

[54] FLUID, COLD-STABLE, TWO-COMPONENT WASHING COMPOSITIONS

[75] Inventor: Wolfgang Bechstedt, Düsseldorf-Garath, Fed. Rep. of Germany

[73] Assignee: Henkel Kommanditgesellschaft auf Aktien, Dusseldorf-Holthausen, Fed. Rep. of Germany

[21] Appl. No.: 86,479

[22] Filed: Oct. 19, 1979

[30] Foreign Application Priority Data

Nov. 2, 1978 [DE] Fed. Rep. of Germany ..... 2847437

[51] Int. Cl.[3] ..... C11D 9/30; C11D 10/04; C11D 10/06; C11D 17/08

[52] U.S. Cl. ..... 8/137; 252/90; 252/92; 252/110; 252/111; 252/117; 252/118; 252/121; 252/122; 252/132; 252/139; 252/153; 252/156; 252/173; 252/DIG. 14

[58] Field of Search ..... 252/108, 109, 110, 111, 252/117, 118, 121, 122, 132, 139, 153, 173, 40, 92; 8/137

[56] References Cited

U.S. PATENT DOCUMENTS

| | | | |
|---|---|---|---|
| 3,723,328 | 3/1973 | Pelizza | 252/111 |
| 3,850,834 | 11/1974 | Hellsten | 252/117 |
| 3,870,647 | 3/1975 | Travers | 252/118 |
| 3,953,351 | 4/1976 | Keller | 252/132 |
| 3,972,823 | 8/1976 | Howarth | 252/132 |
| 4,082,684 | 4/1978 | Kreischer | 252/109 |
| 4,153,569 | 5/1979 | Brom | 252/109 |

FOREIGN PATENT DOCUMENTS

| | | | |
|---|---|---|---|
| 2609752 | 9/1977 | Fed. Rep. of Germany | 252/121 |
| 1460904 | 12/1966 | France . | |
| 338121 | 4/1931 | United Kingdom | 252/121 |
| 1116966 | 6/1968 | United Kingdom . | |

*Primary Examiner*—Dennis L. Albrecht
*Attorney, Agent, or Firm*—Hammond & Littell, Weissenberger and Muserlian

[57] ABSTRACT

A fluid, two-component washing agent consisting of two-components, A and B, of which component A is an aqueous dispersion of fatty acids and component B is an alkaline solution, wherein component A is a cold-stable aqueous dispersion consisting essentially of (a) from 25% to 35% by weight of a substantially unsaturated fatty acids,
(b) from 10% to 16% by weight of a potassium soap of the fatty acids of (a),
(c) from 15% to 25% by weight of an ethoxylated primary alcohol having 5 to 12 oxyethylene units,
(d) from 4% to 10% by weight of a sodium $C_{10-14}$ alkylbenzenesulfonate,
(e) from 0.05% to 1% by weight of at least one optical brightener,
(f) from 1% to 5% by weight of at least one hydrotropic compound,
(g) from 2% to 10% by weight of at least one $C_{1-3}$ alcohol, and
(h) from 15% to 30% by weight of water, and wherein component B is an alkaline solution containing alkaline potassium compounds.

14 Claims, No Drawings

FLUID, COLD-STABLE, TWO-COMPONENT WASHING COMPOSITIONS

BACKGROUND OF THE INVENTION

This invention relates to a fluid, two-component washing agent of which one component is a cold-stable aqueous dispersion of substantially unsaturated fatty acids, which aqueous dispersion is stable at temperatures down to −10° C.

Two-component washing agents are preparations consisting of two separately prepared and stored washing agent components that are combined only immediately before or at the beginning of the wash process. The present invention concerns such an agent in which one component is in the form of a liquid concentrate containing fatty acids as well as other additional surface-active compounds or tensides, and the other component contains the alkali needed for the formation of soap.

A wash process with the use of a two-component washing agent is known from British Pat. No. 338,121. The first component consists of soap-producing fatty acids such as palmitic acid, stearic acid or oleic acid that are present and mixed with emulsifying agents or solvents such as sulfated olive oil, hydrocarbons, terpentine and chlorohydrocarbons. The second component contains the alkalies required for the formation of soap such as alkali metal hydroxide, carbonates, bicarbonates, and silicates and is combined with the first component only in the washing solution. Bleaching components may be added in addition. This process has a number of disadvantages that are important especially in highly automated, commercial laundries.

For example, the fatty acids mentioned are difficult to transport and dose automatically by themselves, while the simultaneous use of solvents from the series of hydrocarbons or chlorohydrocarbons poses considerable problems such as increased danger of fire and explosion or toxicological concerns. Besides, the reaction between the fatty acids, which are not present in a sufficiently fine dispersion, and the alkali proceeds relatively slowly, especially at washing temperatures below 65° C. Furthermore, the reaction is inhibited or partly prevented by the wash, so that fatty acid deposits may form on the wash.

Another process known from French Pat. No. 1,460,904 starts with aqueous fatty acid emulsions suitable for the formation of soap, which combine with the wash alkalies in the washing solution. The fatty acid, which is preferably technical grade oleic acid or a low-melting fatty acid mixture (up to a titer of 45° C.), is emulsified in water with a nonionic emulsifying having a low HLB value agent such as monolaurate or monostearate of polyoxyethylene-sorbitan, with the addition of distilled tall oil, if desired. Alkaline substances are not to be added since these break up the emulsions. It has been found that the cleaning power of the preparations is comparatively low since the emulsifying agents employed do not contribute measurably to the washing power. Furthermore, the stability, especially the stability in cold temperatures, of the emulsions is inadequate since deemulsification occurs below the freezing point, which deemulsification is not readily reversible after heating.

Liquids of the above-mentioned type, particularly in the form of highly concentrated preparations, continue to be interesting despite these problems. Highly concentrated substances help to keep the costs for packing, transport and storage low. As liquids they possess the added advantage of being readily transportable and dosable. This offers definite advantages for commercial laundries equipped with respective mixing and storage tanks as well as for household washing machines equipped with storing and dosing devices as are being developed at present. The dosing of detergent in these novel machines is specially adjusted for each wash program, which prevents wrong dosing, which is undesirable and places a strain on the waste water.

OBJECTS OF THE INVENTION

An object of the invention, with which the described disadvantages are avoided or the mentioned problems solved, is the production of a washing agent consisting of two components, A and B, component A consisting of an aqueous dispersion of soap-producing fatty acids with 12 to 18 carbon atoms and component B, of an aqueous solution of alkaline substances capable of complete soap formation together with the fatty acids of component A, as well as of optionally present sequestering agents characterized in that component A has the following composition:

(a) from 25% to 35% by weight of a $C_{12-18}$ fatty acid having from 60% to 100% of the fatty acids of oleic acid, (b) from 10% to 16% by weight of a potassium soap of said $C_{12-18}$ fatty acids of (a), (c) from 15% to 25% by weight of an ethoxylate of from 5 to 12 ethoxylate units onto a primary alcohol selected from the group consisting of linear $C_{8-14}$-alkanols and $C_{8-14}$-2-methylated-alkanols, (d) from 4% to 10% by weight of a sodium $C_{10-14}$-alkylbenzenesulfonate.

(e) from 0.05% to 1% by weight of an alkali metal salt of substituted stilbenesulfonic acid optical brighteners, (f) from 1% to 5% by weight of a hydrotrope selected from the group consisting of urea and alkali metal salts of alkylbenzenesulfonates having from 1 to 2 alkyl groups with a total of 1 to 3 carbon atoms, (g) from 2% to 10% by weight of alcohols selected from the group consisting of $C_{1-3}$ alkanols and mixtures of $C_{1-3}$ alkanols with up to 50% by weight of the mixtures of $C_{1-4}$-alkoxy-$C_{2-3}$-alkanols or $C_{1-4}$-alkoxy-$C_{2-3}$-alkoxy-$C_{2-3}$-alkanols, and (h) from 15% to 30% by weight of water.

Another object of the present invention is the production of an aqueous dispersion for use in a two-component washing agent composition of which one component contains an aqueous dispersion of fatty acids and the other component contains alkalies, consisting essentially of:

(a) from 25% to 35% by weight of a $C_{12-18}$-fatty acid having from 60% to 100% of the fatty acids of oleic acid, (b) from 10% to 16% by weight of a potassium soap of said $C_{12-18}$ fatty acid of (a), (c) from 15% to 25% by weight of an ethoxylate of from 5 to 12 ethoxylate units onto a primary alcohol selected from the group consisting of linear $C_{8-14}$-alkanols and $C_{8-14}$-2-methylated-alkanols, (d) from 4% to 10% by weight of a sodium $C_{10-14}$-alkylbenzenesulfonate, (e) from 0.05% to 1% by weight of an alkali metal salt of substituted stilbenesulfonic acid optical brighteners, (f) from 1% to 5% by weight of a hydrotrope selected from the group consisting of urea and alkali metal salts of alkylbenzenesulfonates having from 1 to 2 alkyl groups with a total of 1 to 3 carbon atoms, (g) from 2% to 10% by weight of alcohols selected from the group consisting of $C_{1-3}$ alkanols and mixtures of $C_{1-3}$ alkanols with up to 50% by weight of the mixture of $C_{1-4}$-alkoxy-$C_{2-3}$ alkanols or $C_{1-4}$-alkoxy-$C_{2-3}$-alkoxy-$C_{2-3}$-alkanols, and (h) from 15% to 30% by weight of water.

A yet further object of the present invention is to provide a washing agent consisting of two components, of which one is the above aqueous dispersion and the other consists essentially of:

(i) from 0.5% to 5% by weight of sodium tripolyphosphate, (j) from 0 to 25% by weight of potassium tripolyphosphate, (k) from 0 to 10% by weight of a sodium silicate of the composition $Na_2O$: $SiO_2$ 1:1 to 1:3.5, (l) from 0.5% to 5% by weight of sodium ethylenediaminetetraacetate, (m) from 10% to 25% by weight of potassium hydroxide and (n) the remainder up to 100% by weight of water, where the amount of water is sufficient to dissolve all the constituents at room temperature, the ratio of the aqueous dispersion to the above solution being from 1:1 to 1:4, These and other objects of the invention will become more apparent as the description thereof proceed.

DESCRIPTION OF THE INVENTION

The present invention overcomes the described disadvantages and involves a washing agent consisting of two components, A and B, component A consisting of an aqueous dispersion of soap-producing fatty acids with 12 to 18 carbon atoms, and component B consisting of an aqueous solution of alkaline-reacting compounds capable of complete soap formation together with the fatty acids of component A, as well as, optionally, sequestering agents, characterized in that component A has the following composition:

(a) from 25% to 35% by weight of fatty acids with 12 to 18 carbon atoms of which from 60% to 100% by weight of the fatty acids is oleic acid;

(b) from 10% to 16% by weight of a potassium soap of the fatty acid of the composition (a);

(c) from 15% to 25% by weight of an ethoxylated primary linear alkanol, or one with methyl groups in the 2 position, with 8 to 14 carbon atoms, and an average of 5 to 12 ethylene glycol ether groups;

(d) from 4% to 10% by weight of a sodium alkylbenzenesulfonate with linear alkyl chains having 10 to 14 carbon atoms;

(e) from 0.05% to 1% by weight of at least one optical brightener of the class of substituted stilbenesulfonic acids in the form of the Na or K salt;

(f) from 1% to 5% by weight of at least one hydrotropic compound of the class of ureas and the Na or K salts of alkylbenzenesulfonates with 1 to 2 alkyl groups containing a total of 1 to 3 carbon atoms;

(g) from 2% to 10% by weight of at least one alkanol with 1 to 3 carbon atoms or a mixture of said alkanol with alkyl ethers of alkanediols with 1 to 4 carbon atoms in the alkyl and 2 to 3 carbon atoms in the alkanediol; and (h) from 15% to 30% by weight of water.

More particularly, the present invention relates to an aqueous dispersion for use in a two-component washing agent composition of which one component contains an aqueous dispersion of fatty acids and the other component contains alkalies, consisting essentially of:

(a) from 25% to 35% by weight of a $C_{12-18}$ fatty acid having from 60% to 100% of the fatty acids of oleic acid, (b) from 10% to 16% by weight of a potassium soap of said $C_{12-18}$ fatty acids of (a), (c) from 15% to 25% by weight of an ethoxylate of from 5 to 12 ethoxylate units onto a primary alcohol selected from the group consisting of linear $C_{8-14}$-alkanols and $C_{8-14}$-2-methylated-alkanols, (d) from 4% to 10% by weight of a sodium $C_{10-14}$-alkylbenzenesulfonate, (e) from 0.05% to 1% by weight of an alkali metal salt of substituted stilbenesulfonic acid optical brighteners, (f) from 1% to 5% by weight of a hydrotrope selected from the group consisting of urea and alkali metal salts of alkylbenzenesulfonate having from 1 to 2 alkyl groups with a total of 1 to 3 carbon atoms, (g) from 2% to 10% by weight of alcohols selected from the group consisting of $C_{1-3}$ alkanols and mixtures of $C_{1-3}$ alkanols with up to 50% by weight of the mixture of $C_{1-4}$-alkoxy-$C_{2-3}$-alkanols or $C_{1-4}$-alkoxy-$C_{2-3}$-alkoxy-$C_{2-3}$-alkanols, and (h) from 15% to 30% by weight of water.

The fatty acids listed under (a) consists of from 60% to 100%, preferably from 65% to 95% by weight of the fatty acids of oleic acid. Polyunsaturated fatty acids, such as linoleic acid, may be contained in the fatty acids, in addition to oleic acid, in proportions of from 0 to 25%, preferably 1% to 15% by weight of the fatty acids. The proportion of saturated fatty acids with 12 to 18 carbon atoms is from 0 to 35%, preferably 2% to 20% by weight of the fatty acids, with the proportion of stearic acid not to exceed 5% by weight, especially 3% by weight. Suitable fatty acid mixtures have the following composition (in % by weight):

0 to 10%, preferably 0.1% to 5%, lauric acid,
0 to 10%, preferably 0.5% to 5%, myristic acid,
0 to 15%, preferably 1% to 10%, palmitic acid,
0 to 5%, preferably 0 to 3%, stearic acid,
60% to 100%, preferably 65% to 95%, oleic acid,
0 to 25%, preferably 1% to 15%, linoleic acid The amount of the fatty acids listed under (a) is preferably from 30% to 34% by weight of the aqueous dispersion.

The potassium soap listed under (b) is derived from the fatty acids of aforementioned composition and is present preferably in proportions of from 12% to 15% by weight of the aqueous dispersion.

The ethoxylated alcohols listed under (c) are derived from natural or synthetic alcohols, particularly oxoalcohols with 8 to 14, preferably 9 to 12 carbon atoms. The oxoalcohols may be linear or have methyl groups in the 2 position. Also suitable are mixtures of natural fatty alcohols and those obtained by the oxoreaction. The average number of ethylene glycol ether groups is from 5 to 12, preferably 6 to 8. The proportion of the ethoxylated alcohols in the aqueous dispersion amounts to 15% to 25%, preferably 18% to 22% by weight.

Component (d) consists of a sodium linear alkylbenzenesulfonate, having from 10 to 14 carbon atoms in the alkyl, especially dodecylbenzenesulfonate, in amounts of from 4% to 10%, preferably 6% to 8% by weight of the aqueous dispersion.

The optical brighteners of component (e) are alkali metal salts, preferably Na and K salts of the substituted stilbenesulfonic acids and are derived from compounds of the formulas

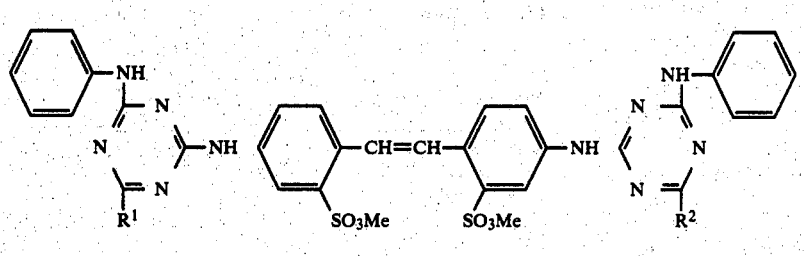

(I)

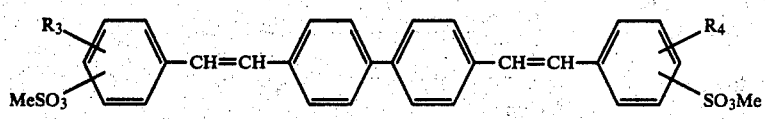

(II)

in which the individual symbols Me, $R_1$, $R_2$, $R_3$ and $R_4$ have the following significance:

Me=Na, K $R_1$, $R_2$= —$NHCH_3$, —$NCH_3(CH_2CH_2OH)$, —$N(CH_2CH_2OH)_2$

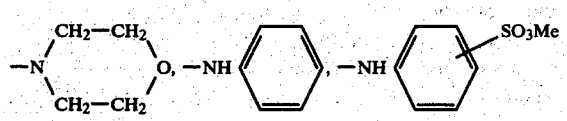

$R_3$, $R_4$=H, —$CH_3$, —Cl, —$OCH_3$, —$COOCH_3$, —CN, —$SO_2NR_5R_6$, —$CONR_5R_6$ with $R_5$ and $R_6$=H or alkyl with 1 to 3 carbon atoms.

Optical brighteners of the formula I, in which $R_1$ and $R_2$ represent morpholino, diethanolamino or anilino radicals, are preferable. The optical brighteners are present in proportions of from 0.05% to 1%, preferably 0.1% to 0.7% by weight of the aqueous dispersion.

The hydrotropic compounds mentioned under (f) may be urea and/or low-molecular weight alkyl or dialkylbenzenesulfonates such as toluene, ethylbenzene, cumene or xylene sulfonate in the form of the Na or K salts. Their proportion is preferably from 1.5% to 3% by weight of the aqueous dispersion.

Component (g) consists of aliphatic $C_1$–$C_3$ alkanols, such as ethanol, propanol and particularly isopropanol, as well as of the mixtures of the mentioned alkanols. The content of these alkanols in the products is preferably up to 8% by weight. Products with proportions of less than 4% of the mentioned alkanols can also contain hydrotropically active ether alcohols derived from $C_1$–$C_4$-monoalkanols and ethylene glycol or propylene glycol or di-ethylene glycol. Suitable are methoxyethanol, ethoxyethanol, propoxyethanol, isopropoxyethanol, or butoxyethanol.

The water content of the concentrated aqueous dispersion is from 15% to 30%, preferably 15% to 22% by weight. The shelf-life of the concentrated aqueous dispersions is unlimited in the temperature range between +50° C. and −10° C. They do become pasty after several weeks of storage at a temperature of −10° C., but do not deemulsify even under such extreme conditions and again form liquids upon rewarming that are easy to pour and quite clear.

Other additives that may be present in the aqueous dispersions are biocides, fragrances, dyes, stabilizers, sequestering agents, neutral salts and optical brighteners of other types than those specified, but the proportion of such additives should not exceed a total of 10% by weight and preferably be less than 5% by weight, particularly less than 2% by weight, to prevent a negative influence on stability in cold temperatures.

Component B, which is combined, before or at the beginning of the washing process, with the above-described aqueous dispersion to form fatty acid soaps, consists, in the simplest case, of an aqueous solution of alkalies, that is alkali metal hydroxides, carbonates, silicates, phosphates and polyphosphates, particularly of sodium or potassium, or mixtures of the above-mentioned alkaline compounds. The alkalinity as well as the amount of these alkalies is calculated such that the fatty acids are converted completely into soaps and that an excess of alkali remains beyond that, so that the pH of the washing solution is 9.5 to 14, preferably at least 10 and especially 10.2 to 13.5. Other compounds with a sequestering effect may be present in addition to the alkalies or polyphosphates with a sequestering effect, such as the Na or K salts of polycarboxylic acids, hydroxypolycarboxylic acids, ether-polycarboxylic acids, aminopolycarboxylic acids, hydroxy-alkanephosphonic acids and aminopolyphosphonic acids. Examples of particularly serviceable compounds are nitrilotriacetic acid, ethylenediaminetetraacetic acid, diethylenetriaminepentaacetic acid, 1-hydroxyethane-1,1-diphosphonic acid, 1-aminoethane-1,1-diphosphonic acid and aminotri-(methylenephosphonic acid).

A liquid solution of wash alkalies that is easily dosed and especially resistant to cold temperatures and was found to be a particularly suitable component B for automated laundries has the following composition:

(i) from 0.5% to 5% by weight of sodium tripolyphosphate, (j) from 0 to 25% by weight of potassium tripolyphosphate, where the total amount of tripolyphosphates is preferably from 5% to 20% by weight, (k) from 0 to 10% by weight, preferably from 1% to 5% by weight of sodium silicate of the composition $Na_2O$: $SiO_2$=1:1 to 1:3.5, (l) from 0.5% to 5% by weight of sodium ethylenediaminetetraacetate, (m) from 10% to 25% by weight, preferably 15% to 22% by weight of potassium hydroxide; and (n) the remainder up to 100% by weight of water. Preferably the amount of water is sufficient to dissolve all the constituents of component B at room temperature.

The ratio of the mixture of component A with the liquid component B according to the above composition is 1:1 to 1:4, preferably 1:2 to 1:3, where the total amount of all wash-active components and washing alkalies in the washing solution amounts to 5 gm to 30 gm, preferably to 10 to 25 gm, per kg of dry wash.

More particularly, therefore, the present invention also resides in a washing agent consisting of two components, A and B, wherein component A is an aqueous dispersion of fatty acids consisting essentially of (a) from 25% to 35% by weight of a $C_{12-18}$ fatty acid having from 60% to 100% of the fatty acids of oleic acid, (b) from 10% to 16% by weight of a potassium soap of said $C_{12-18}$ fatty acid of (a), (c) from 15% to 25% by weight of an ethoxylate of from 5 to 12 ethoxylate units onto a primary alcohol selected from the group consisting of linear $C_{8-14}$-alkanols and $C_{8-14}$-2-methylated-alkanols, (d) from 4% to 10% by weight of a sodium $C_{10-14}$-alkylbenzenesulfonate, (e) from 0.05% to 1% by weight of an alkali metal salt of substituted stilbenesulfonic acid optical brighteners, (f) from 1% to 5% by weight of a hydrotrope selected from the group consisting of urea and alkali metal salts of alkylbenzenesulfonates having from 1 to 2 alkyl groups with a total of 1 to 3 carbon atoms, (g) from 2% to 10% by weight of alcohols selected from the group consisting of $C_{1-3}$ alkanols and mixtures of $C_{1-3}$ alkanols with up to 50% by weight of the mixture of $C_{1-4}$-alkoxy-$C_{2-3}$-alkanols or $C_{1-4}$-alkoxy-$C_{2-3}$-alkoxy-$C_{2-3}$-alkanols, and (h) from 15% to 30% by weight of water; and Component B is an aqueous solution of alkalies consisting essentially of (i) from 0.5% to 5% by weight of sodium tripolyphosphate, (j) from 0 to 25% by weight of potassium tripolyphosphate, (k) from 0 to 10% by weight of a sodium silicate of the composition $Na_2O:SiO_2$, 1:1 to 1:3.5, (l) from 0.5% to 5% by weight of sodium ethylenediaminetetraacetate, (m) from 10% to 25% by weight of potassium hydroxide, and (n) the remainder up to 100% by weight of water, where the amount of water is sufficient to dissolve all the constituents at room temperature; where the ratio of component A to component B in the combination for washing is from 1:1 to 1:4.

The subject of the invention further is a washing process, using the two components, A and B, according to the above-mentioned compositions, mixing ratios and concentrations. Still other components may be added for these washing processes, such as sodium aluminosilicates capable of cation exchange as described in British Pat. No. 1,473,201 and copending, commonly-assigned Ser. No. 956,851, filed Nov. 2, 1978, greying inhibitors such as cellulose ether and cellulose mixed ethers, enzymes as well as bleaches containing active oxygen or active chlorine, optionally with the addition of bleach activators. As far as the stability of the respective compounds permits, these are also preferably in the form of solutions or dispersions, with an inadequate stability being corrected, if necessary, by enclosing the active substances in a capsule.

The following examples are illustrative of the practice of the invention without being limitative in any respect.

EXAMPLES

The fatty acid mixtures employed in the examples as component (a) or the potassium soaps of component (b) had the composition given in Table I (in % by weight).

TABLE I

| | $a_1$ or $b_1$ | $a_2$ or $b_2$ |
|---|---|---|
| lauric acid | 1.2 | 0.5 |
| myristic acid | 3.4 | 1.5 |
| palmitic acid | 8.6 | 5.7 |
| stearic acid | 1.8 | 2.1 |
| oleic acid | 73.0 | 82.0 |
| 9, 12-linoleic acid | 12.0 | 8.2 |

An oxoalcohol with the chain length $C_9$ to $C_{11}$ and 7 ethylene glycol ether groups was used as the ethoxylated alcohol component (c). Component (d) consisted of linear Na dodecylbenzenesulfonate. The sodium salt (Me=Na) of the compound according to formula I, in which $R_1$ and $R_2$ are morpholino radicals, was used as the optical brighteners component (e). Urea or potassium toluenesulfonate was used as the hydrotropic substance component (f). Component (g) consisted of isopropanol. The component "salts" includes small amounts of $Na_2SO_4$ and NaCl, which were present as adjuvants of the alkylbenzenesulfonate and the optical brightener. The compositions of Examples 1 to 4 are given in Table 2.

TABLE 2

| Constituent | Examples | | | |
|---|---|---|---|---|
| Component A | 1 | 2 | 3 | 4 |
| fatty acid $a_1$ | 32.0 | 33.0 | — | — |
| fatty acid $a_2$ | — | — | 31.0 | 34.0 |
| soap $b_1$ | 15.0 | 14.0 | — | — |
| soap $b_2$ | — | — | 16.0 | 13.5 |
| c | 19.0 | 20.0 | 21.0 | 20.0 |
| d | 7.0 | 7.0 | 6.0 | 7.0 |
| e | 0.5 | 0.5 | 0.5 | 0.5 |
| urea | 2.0 | — | 2.0 | — |
| toluenesulfonate | — | 2.0 | — | 2.0 |
| isporopanol | 5.0 | 5.5 | 4.5 | 5.0 |
| salts | 0.5 | 0.5 | 0.5 | 0.5 |
| water | 19.0 | 17.5 | 18.5 | 17.5 |

For the preparation of the component A aqueous dispersion, the fatty acid mixture was mixed with the amount of potassium hydroxide necessary to form soap as well as with the ethoxylate and the alkylbenzenesulfonate, which was in the form of a 50% aqueous solution, then the optical brightener dissolved in isopropanol was stirred in and finally the hydrotropic agent as well as water in the specified amount was added.

The concentrates were yellowish, clear to slightly iridescent solutions that were thin liquids at room temperature and which remained clear and homogeneous after three weeks of storage in controlled temperature chambers at −10° C. and +50° C. A repeated temperature change between +50° C. and −10° C. did not cause deemulsification. The concentrates were miscible with water at any ratio.

The following solutions, the constitutions of which are given in Table 3, were used as the alkaline component B (amounts in % by weight):

TABLE 3

| Constituent Component | Examples 5 | 6 | 7 |
|---|---|---|---|
| $Na_5P_3O_{10}$ | 5.0 | 5.0 | 5.0 |
| $K_5P_3O_{10}$ | 5.0 | 9.0 | 15.0 |
| KOH | 22.0 | 20.0 | 18.0 |
| $Na_2O$ . 3.3 $SiO_2$ | 2.8 | 2.8 | 2.8 |
| EDTA (Na salt) | 2.0 | 2.0 | 2.0 |
| water | 63.2 | 61.2 | 57.2 |

The solutions were also stable in a temperature range of from −10° C. to +50° C.

When component A of Examples 1 to 4 and component B of Examples 5 to 7 were combined for the washing process, the following proportions were employed:

Single-Solution Process 5 to 10 gm of component A per kg of dry wash
12 to 15 gm of component B per kg of dry wash Two-solution Process Prewash
3 to 6 gm of component A per kg of dry wash
12 to 15 gm of component B per kg of dry wash
Main Wash
2 to 5 gm of component A per kg of dry wash
5 to 8 gm of component B per kg of dry wash Perfect washing results were obtained with a solution ratio (kg of dry wash per liter of washing solution) of 1:4 to 1:10, with the use of softened water.

The preceding specific embodiments are illustrative of the practice of the invention. It is to be understood however, that other expedients known to those skilled in the art or disclosed herein, may be employed without departing from the spirit of the invention or the scope of the appended claims.

I claim:

1. A method of washing soiled textiles consisting of the steps of adding a washing agent consisting of two components, A and B wherein component A is an aqueous dispersion of fatty acids consisting essentially of (a) from 25% to 35% by weight of a $C_{12-18}$ fatty acid having from 60% to 100% of the fatty acids of oleic acid,
(b) from 10% to 16% by weight of a potassium soap of said $C_{12-18}$ fatty acid of (a),
(c) from 15% to 25% by weight of an ethoxylate of from 5 to 12 ethoxylate units onto a primary alcohol selected from the group consisting of linear $C_{8-14}$-alkanols and $C_{8-14}$-2-methylated-alkanols,
(d) from 4% to 10% by weight of a sodium $C_{10-14}$-alkylbenzenesulfonate,
(e) from 0.05% to 1% by weight of an alkali metal salt of substituted stilbenesulfonic acid optical brighteners,
(f) from 1% to 5% by weight of a hyrotrope selected from the group consisting of urea and alkali metal salts of alkylbenzenesulfonates having from 1 to 2 alkyl of groups with a total of 1 to 3 carbon atoms,
(g) from 2% to 10% by weight of alcohols selected from the group consisting of $C_{1-3}$ alkanols and mixtures of $C_{1-3}$ alkanols with up to 50% by weight of the mixture of $C_{1-4}$-alkoxy-$C_{2-3}$-alkanols or $C_{1-4}$-alkoxy-$C_{2-3}$-alkoxy-$C_{2-3}$-alkanols, and
(h) from 15% to 30% by weight of water; and component B is an aqueous solution of alkalies consisting essentially of
(i) from 0.5% to 5% by weight of sodium tripolyphosphate,
(j) from 0 to 25% by weight of potassium tripolyphosphate,
(k) from 0 to 10% by weight of a sodium silicate of the composition $Na_2$—:$SiO_2$ 1:1 to 1:3.5,
(l) from 0.5% to 5% by weight of sodium ethylenediaminetetraacetate,
(m) from 10% to 25% by weight of potassium hydroxide, and
(n) the remainder up to 100% by weight of water, where the amount of water is sufficient to dissolve all the constituents at room temperature; where the ratio of component A to component B in the combination for washing is from 1:1 to 1:4 and where the washing solution has a pH of from 9.5 to 14, to an aqueous wash liquor containing soiled textiles in such amounts that the total amount of all active washing ingredients including wash alkalies is from 5 gm to 30 gm per kg of dry textiles, agitating said textiles in said wash liquor, draining and rinsing said textiles and recovering clean textiles.

2. The method of washing of claim 1 wherein the fatty acid component (a) consists of 65% to 95% by weight of oleic acid, does not contain more than 3% by weight of stearic acid and is present in an amount of from 30% to 34% by weight of the dispersion.

3. The method of claim 2 wherein the potassium soap component (b) is present in an amount of from 12% to 15% by weight of the dispersion.

4. The method of claims 1 or 2 wherein the ethoxylate component (c) is an ethoxylate of from 6 to 8 ethoxylate units onto said primary alcohol having from 9 to 12 carbon atoms and is present in an amount of from 18% to 22% by weight of the dispersion.

5. The method of claim 1 or 2 or 4 where said component (d) is sodium dodecylbenzenesulfonate and is present in an amount of from 6% to 8% by weight of the disersions.

6. The method of claim 1 or 2 or 4 wherein said optical brighteners component (c) is a compound of the formula selected from the group consisting of

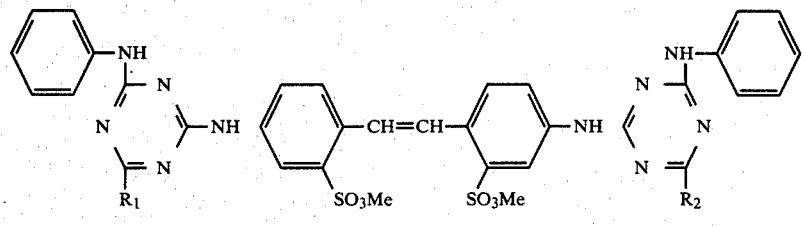

-continued

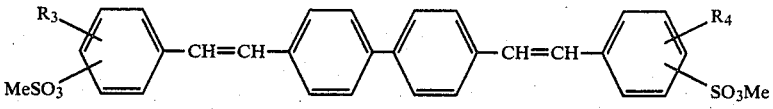

wherein Me is a member selected from the group consisting of sodium and potassium, $R_1$ and $R_2$ are members selected from the group consisting of Me=Na, K $R_1$, $R_2$=—$NHCH_3$, —$NCH_3(CH_2CH_2OH)$, —$N(CH_2CH_2OH)_2$

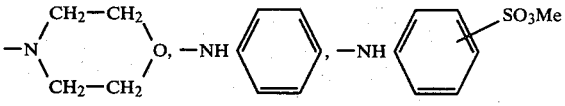

$R_3$ and $R_4$ are members selected from the group consisting of H, —$CH_3$, —Cl, —$OCH_3$, —$COOCH_3$, —CN, —$SO_2NR_5R_6$, and —$CONR_5R_6$, $R_5$ and $R_6$ are members selected from the group consisting of hydrogen and alkyl having from 1 to 3 carbon atoms.

7. The method, of claim 1 wherein said hydrotrope component (f) is present in an amount of from 1.5% to 3% by weight of the dispersion.

8. The method of claim 1 wherein said alcohol component (g) is isopropanol and is present in an amount of from 3% to 8% by weight of the dispersion.

9. The method of claim 1 or 2 or 4 wherein said water component (h) is present in an amount of from 16% to 22% by weight.

10. The method of claim 1 wherein said washing solution has a pH of from 10.2 to 13.5.

11. The method of claim 1 wherein the ratio of component A to component B in the combination for washing is from 1:2 to 1:3.

12. The method of claim 1 wherein the total amount of all active washing ingredients including wash alkalies in said wash liquor is from 10 gm to 25 gm per kg of dry textiles.

13. A method of washing soiled textiles consisting of the steps of adding a washing agent consisting of two components, A and B wherein component A is an aqueous dispersion of fatty acids consisting essentially of (a) from 25% to 35% by weight of a $C_{12-18}$ fatty acid having from 60% to 100% of the fatty acids of oleic acid, (b) from 10% to 16% by weight of a potassium soap of said $C_{12-18}$ fatty acid of (a), (c) from 15% to 25% by weight of an ethoxylate of from 5 to 12 ethoxylate units onto a primary alcohol selected from the group consisting of linear $C_{8-14}$-alkanols and $C_{8-14}$-2-methylated-alkanols, (d) from 4% to 10% by weight of a sodium $C_{10-14}$-alkylbenzenesulfonate, (e) from 0.05% to 1% by weight of an alkali metal salt of substituted stilbenesulfonic acid optical brighteners, (f) from 1% to 5% by weight of a hydrotrope selected from the group consisting of urea and alkali metal salts of alkylbenzenesulfonates having from 1 to 2 alkyl groups with a total of 1 to 3 carbon atoms, (g) from 2% to 10% by weight of alcohols selected from the group consisting of $C_{1-3}$ alkanols and mixtures of $C_{1-3}$ alkanols with up to 50% by weight of the mixture of $C_{1-4}$-alkoxy-$C_{2-3}$-alkanols or $C_{1-4}$-alkoxy-$C_{2-3}$-alkoxy-$C_{2-3}$-alkanols, and (h) from 15% to 30% by weight of water; and component B is an aqueous solution of alkalies consisting essentially of (i) from 0.5% to 5% by weight of sodium tripolyphosphate, (j) from 0 to 25% by weight of potassium tripolyphosphate, (k) from 0 to 10% by weight of a sodium silicate of the composition $Na_2O:SiO_2$ 1:1 to 1:3.5, (l) from 0.5% to 5% by weight of sodium ethylenediaminetetraacetate, (m) from 10% to 25% by weight of potassium hydroxide, and (n) the remainder up to 100% by weight of water, where the amount of water is sufficient to dissolve all the constituents at room temperature; where the ratio of component A to component B in the combination from washing is from 1:1 to 1:4, and where the washing solution has a pH of from 9.5 to 14, to an aqueous wash liquor in the absence of soiled textiles in such amounts that the total amount of all active washing ingredients including wash alkalies in the wash liquor after addition of said soiled textiles is from 5 gm to 30 gm per kg of dry textiles, adding said soiled textiles agitating said textiles in said wash liquor, draining and rinsing said textiles and recovering clean textiles.

14. The method of claim 13 wherein the total amount of all active washing ingredients including wash alkalies in said wash liquor is from 10 gm to 25 gm per kg of dry textiles.

* * * * *